US005774026A

United States Patent [19]

Cunin et al.

[11] Patent Number: 5,774,026

[45] Date of Patent: Jun. 30, 1998

[54] HIGH FREQUENCY IMPEDANCE TRANSFORMER

[75] Inventors: Bernard Cunin, Strasbourg; Paul Geist, Schiltigheim; Alphonse Martz, Kilstett; Joseph-Albert Miehe, Strasbourg, all of France

[73] Assignee: Communaute Europeenne, Luxembourg, Luxembourg

[21] Appl. No.: 765,183

[22] PCT Filed: Jun. 22, 1995

[86] PCT No.: PCT/FR95/00836

§ 371 Date: Jan. 7, 1997

§ 102(e) Date: Jan. 7, 1997

[87] PCT Pub. No.: WO96/02073

PCT Pub. Date: Jan. 25, 1996

[30] Foreign Application Priority Data

Jul. 7, 1994 [FR] France ..... 94 08598

[51] Int. Cl.[6] ..... H01P 5/04

[52] U.S. Cl. ..... 333/111; 333/115; 333/116; 333/33

[58] Field of Search ..... 333/33, 111, 115, 333/116

[56] References Cited

U.S. PATENT DOCUMENTS

| | | | |
|---|---|---|---|
| 3,166,723 | 1/1965 | Bock et al. | 333/111 |
| 3,363,201 | 1/1968 | Isaacson | 333/111 |
| 3,560,885 | 2/1971 | Chao | 333/111 |
| 4,754,241 | 6/1988 | Spinner | 333/111 |

FOREIGN PATENT DOCUMENTS

| | | |
|---|---|---|
| 62-154901 | 7/1987 | Japan . |
| 573365 | 11/1945 | United Kingdom . |

OTHER PUBLICATIONS

Bryukhnevich et al., "Matching of the Shutter and Deflecting Systems of a PIM–3 Image Converter with a Control Circuit", *Instruments and Experimental Techniques,* vol. 15, No. 6, Dec. 1972, New York, pp. 1798–1802.

*Primary Examiner*—Paul Gensler
*Attorney, Agent, or Firm*—Young & Thompson

[57] ABSTRACT

A coupling and matching device for high frequency or microwave signal transmission includes two line sections (9, 10) with parallel, weakly coupled portions (9', 10'), where the primary section (9) forms a short circuit and is connected to a relatively low output impedance device while the secondary section (10) is connected to a relatively high input impedance device. The coupling and matching device also includes a ground plane parallel to the secondary line section (10), and a member (12) for varying the difference between the secondary line section and the ground plane.

10 Claims, 2 Drawing Sheets

HIGH FREQUENCY IMPEDANCE TRANSFORMER

The present invention relates to the field of transmission of signals between apparatus for circuits having different physical and electrical characteristics and requiring matching, and has for its object a coupling and matching circuit adapted to interconnect a low impedance output device and a very high impedance input device, for the transmission of high frequency and ultra-high frequency signals.

Although the invention is not limited to use with specific types of devices to be connected, it will be described hereinafter more particularly in the framework of application to a scanning slot camera.

Scanning slot cameras operating by synchronous scanning, also called "synchroscan", are often used to observe recurrent luminous phenomena which repeat with a constant frequency $f_0$ of the order of about 100 megahertz (MHz).

This manner of operation is very interesting because it has different important advantages, namely:

- the measurement sensitivity is very high because the luminous trace on the screen results from the accumulation of a large number of elemental traces,
- the voltage V(t) applied to the deflection plates of the image converter tube is sinusoidal and, because of this, its elaboration is easier than that of a linear trace,
- it is relatively less sensitive to phase fluctuations of the luminous signal.

Figure 1:
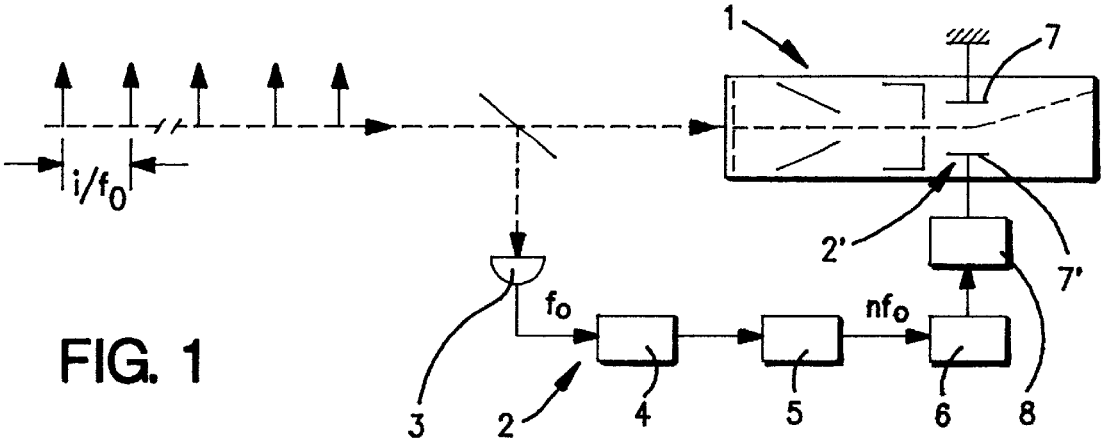

The operating diagram of such a camera 1 and of its synchronization loop 2 for its sweeping circuit 2' is reproduced in FIG. 1 of the accompanying drawings.

A portion of the luminous signal to be analyzed is converted by a rapid photodiode 3 and a voltage of frequency $1/f_0$ which is shaped, then frequency multiplied by a matched circuit 4.

The harmonic of quality n is then isolated by a pass-band filter 5, supplied to a power amplifier 6 and, finally, supplied to the deflection plates 7, 7' of the sweeping circuit 2' by means of a matching unit 8, in this case in the form of a selective impedance transformer whose purpose is to optimize the power transfer between the amplifier 6 and the sweeping circuit 2'.

The voltage difference V(t) developed across the terminals of the deflection plates 7, 7' is thus of the form:

$V(t)=V_0\sin(2\pi n f_0 t)$ wherein $n \leqq 1$

For usual deviation sensitivities (<300 V/cm) and for a fairly high amplitude $V_0$ (~1 kV) it can be considered that the deflection of the electron beam in a field of radius 1.5 cm is a quasi-linear function of time.

At present, the temporal resolution of so-called "synchroscan" cameras is principally determined by the dynamic spatial resolution of the tube (~60 $\mu$m) divided by the speed of deflection.

This latter being proportional to the temporal derivative of voltage V(t), it is evident that it is of interest to optimize the product $nV_0$.

In general, the amplitude $V_0$ is regulated in such a manner that the power dissipated in the tube will be adjacent the maximum permissible (~5 W). As to the parameter n, it is often taken to be equal to unity ($nf_0$~100 MHz) because the production of the matching transformer 8 is simpler: the temporal resolution is then about 1.5 ps.

In practice, the scanning frequency is limited upwardly by the resonance of the tube which is ordinarily between 500 and 600 MHz. It follows that its maximum value corresponds to: n=5, for which value the theoretical resolution is less than 500 fs. However, in this frequency range, the transformers of magnetic type employed at 100 MHZ are unusable and cannot be matched to the level of their secondary, because of the self-inductance of this latter.

There is known from U.S. Pat. No. 3,166,723 a bidirectional coupling device for the transmission of high frequency and ultra high frequency signals constituted by two line sections having portions arranged in parallel and weakly coupled with each other and by a ground plane disposed parallel to the secondary line portion and adapted to form a part of a shielding envelope surrounding said circuit.

This known device also comprises a device for adjusting the degree of coupling between the primary and the secondary by bringing the primary and secondary conductors toward or away from each other in the coupling region.

However, this coupling device does not permit providing an adaptation of impedance between a circuit connected to the primary and a circuit connected to the secondary, which have quite different impedances.

Moreover, this known coupling device has no means permitting tuning the secondary.

The problem posed by the present invention consists, accordingly, in designing and producing a coupling and matching circuit, of simple structure, less cumbersome, permitting ensuring the transmission of high frequency and ultra-high frequency signals (from several tens of MHz to several GHz) between two unconnected and unmatched devices, having very different impedances, particularly between a high frequency amplifier or generator of a scanning synchronization loop and the integrated circuit or scanning device or the deflection plates of a slot scanning camera operating in the so-called "synchroscan" mode.

Moreover, the coupling and matching circuit to be designed must also be adapted to be tuned to its secondary, as a function of the device connected to this latter.

To this end, the present invention has for its object a coupling and matching circuit for the transmission of high frequency and ultra high frequency signals, constituted, on the one hand, by two line sections having portions disposed in parallel and weakly coupled to each other, by a ground plane disposed parallel to the secondary line section and adapted to form a part of a shielding envelope surrounding said coupling and matching circuit, which circuit is characterized in that it comprises moreover a means for displacement of the secondary line section relative to the ground plane and/or for variation of the length of the secondary line section located facing said ground plane and that it interconnects a low impedance output device and a relatively high impedance input device, the primary line section, forming a short circuit, being connected to the low impedance output device and the secondary line section being connected to the relatively high impedance input device.

Figure 2:
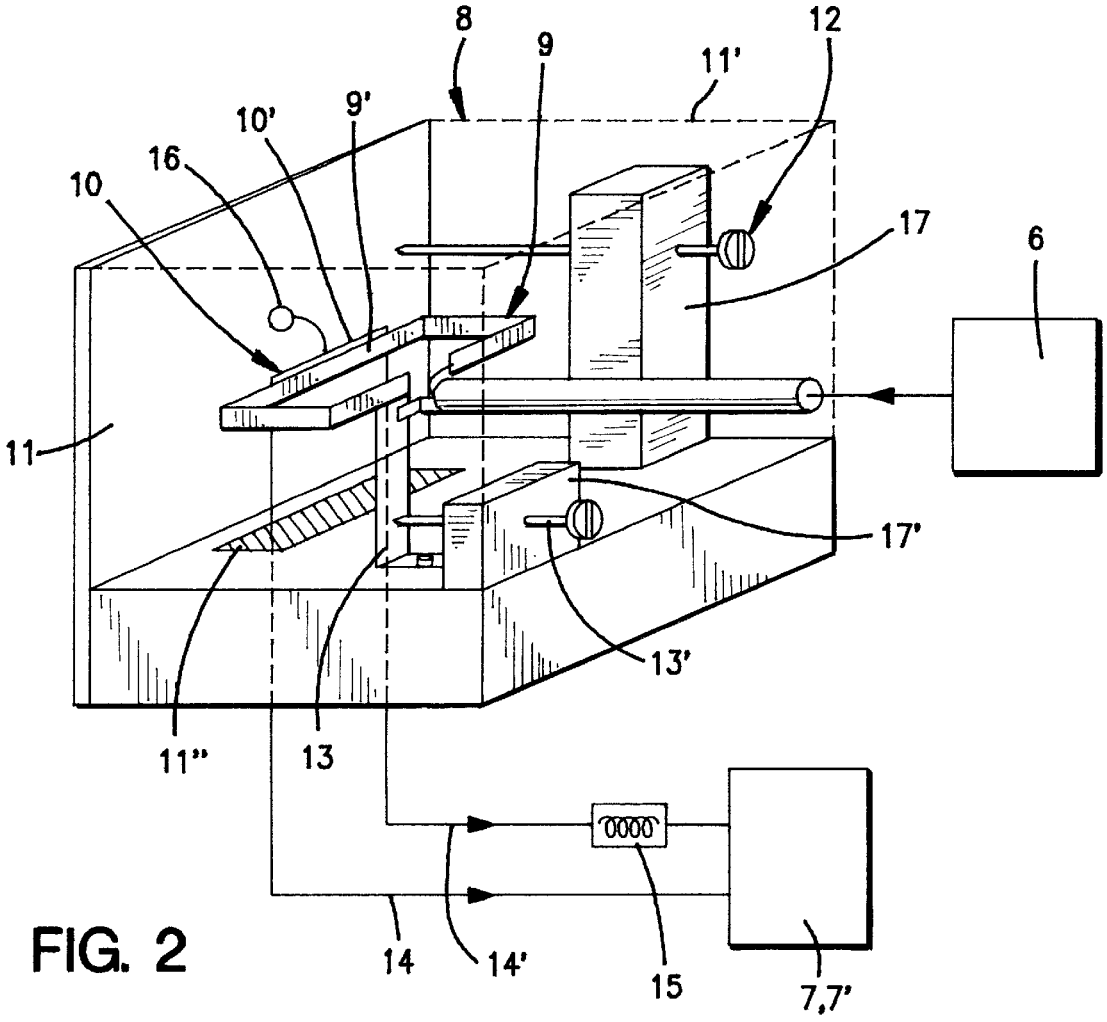
Figure 3:
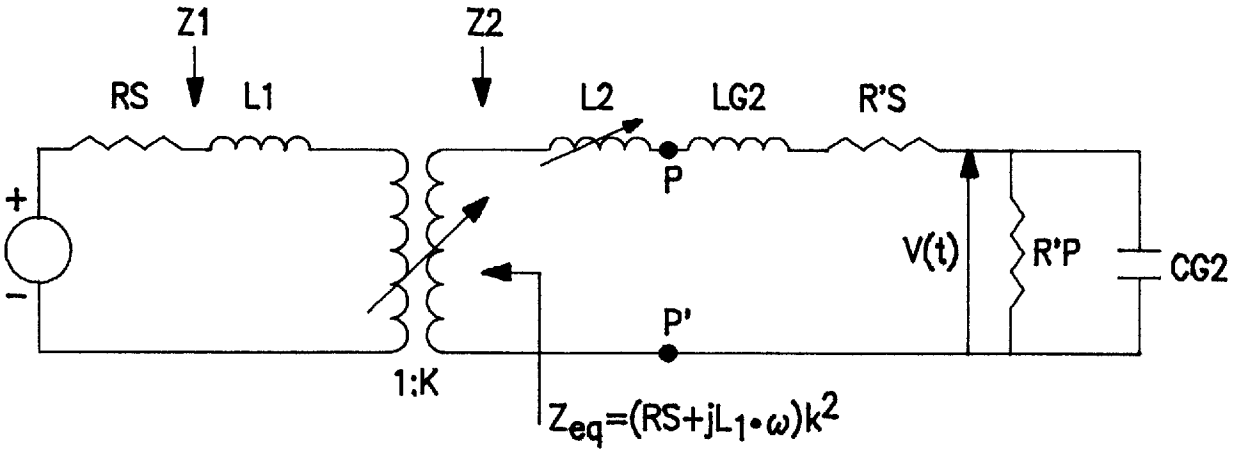

The invention will be better understood from the following description, which relates to preferred embodiments, given by way of non-limiting examples, and explained with the accompanying drawings, in which:

FIG. 1 is a schematic representation of a slot sweeping camera operating in the so-called "synchroscan" mold together with its loop for synchronization of sweeping, FIG. 2 is a perspective view of a coupling and matching circuit according to the invention, connected to the two devices to be connected, and, FIG. 3 is an equivalent electrical diagram of the assembly of the low impedance output device (HF amplifier or generator) and the coupling and matching circuit and the very high impedance input device, shown in FIG. 2.

As shown more particularly in FIG. 2 of the accompanying drawings, the coupling and matching circuit 8 for the transmission of high frequency and hyperfrequency signals, is constituted on the one hand by two line sections 9, 10 having portions 9', 10' disposed in parallel and weakly coupled with each other, and, on the other hand, by a ground plane 11 disposed in parallel to the secondary line section 10 and adapted to form a part of an electromagnetic shielding envelope 11' surrounding said coupling and matching circuit 8.

According to the invention, said circuit 8 comprises moreover a means 12 for relative displacement of the secondary line section 10 relative to the ground plane 11 and/or for variation of the length of the secondary line section 10 located facing said ground plane 11 and interconnects a device 6 of low output impedance and a device 7, 7' of relatively high input impedance, the primary line section 9 forming a short circuit, being connected to the low output impedance device 6 and the secondary line section 10 being connected to the relatively high input impedance device.

According to a first characteristic of the invention, the coupling and matching circuit 8 also comprises means 13, 13'for relative displacement, in terms of spacing distance, of the primary line section 9 relative to the secondary line section 10 or vice versa, more particularly of their respective facing portions 9' and 10', thereby permitting regulating the degree of coupling between the two line sections 9 and 10 and hence the transformation ratio k, between the primary and the secondary, with matching of the output resistance RS of the device 6 with the input resistance R'S+R'P of the device 7, 7', due to the ohmic and dielectric losses.

According to a preferred embodiment of the invention, shown in FIGS. 2 and 3 of the accompanying drawings, the primary line section 9 consists of a microribbon or microstrip line in the air, whose length and characteristic impedance Z1 are sufficiently low that its equivalent inductance L1 will be negligible relative to the output resistance RS of the device 6 with low output impedance and the secondary line section 10 is comprised by a microribbon line in the air and has a characteristic impedance Z2 sufficiently high that said secondary line section 10 can be assimilated to a pure inductance L2 whose value is given by the expression:

$$L2=Z2\times l/c$$

wherein l is the length of the secondary line section 10 facing the ground plane 11, and c is the speed of light.

According to another preferred characteristic of the invention, it is provided that for a given value of inductance L2 of the secondary line section 10, the sum LG2 of the values of the inductances of the device 7, 7' of very high input impedance, of the connection wires 14, 14' and of a possible trimming self-inductance winding 15, is fixed such that:

$$(L2+LG2)\omega=l/CG2\times\omega$$

in which CG2 corresponds to the overall capacitance of the device 7, 7' of very high input impedance, of the connection wires 14, 14' and of the secondary line section 10, and ω corresponds to the pulsation or angular frequency of the transmitted signals (see FIGS. 2 and 3).

So as to be able to supply to the secondary voltages of opposite signs (and of identical absolute values) and to improve the rate of rejection of the common mode, the midpoint 16 of the secondary line section 10, generally merged with the midpoint of the portion 10', can preferably be grounded, for example by connection to the ground plane 11.

The connection to the secondary can be effected, for example, either by adjustment means of the length of the secondary line section 10 located in the housing constituted by the shielding envelope 11', these means being adapted to be disposed on the external surface of said housing and at the output of the connection lines 14, 14' or of the ends of the secondary line section 10 (passing through the shielded housing in a region 11" of insulating material), or by a system of displacement by translation of said ground plane 11 relative to the secondary line section 10 in a direction perpendicular to the axis of the portion 10'.

However, according to a simple and preferred modification of the invention, and as shown in FIG. 2 of the accompanying drawings, the means 12 for displacement relative to the secondary line section 10 with respect to the ground plane 11 consists in a member for deformation by flexure of said ground plane 11.

Moreover, for the adjustment of the distance between the sections 9' and 10' facing the line portions 9 and 10, it can be provided, as shown also in FIG. 2 of the accompanying drawings, that the primary line section 9 will be mounted on a support 13 adapted to be displaced or inclined, by deformation for example, in a direction perpendicular to the longitudinal axes of the portions 9' and 10' of the primary line section 9 and secondary line section 10 parallel to each other, while actuating a member 13' for adjustment of the position of said support 13.

According to another characteristic of the invention, the means 12 and 13' for deformation and adjustment of the position consist in screws with a small pitch, disposed in fixed insulating supports 17, 17' each provided with at least one corresponding screw-threaded opening, the heads of said screws being preferably located outside the shielding envelope 11' so as to facilitate accessibility and manual adjustment.

Although described above in the general framework of a connection between a device 6 with low output impedance and a device 7, 7' with very high input impedance, the circuit 8 for coupling and matching according to the invention is more particulary adapted to be integrated into a synchronization loop 2 of scanning, connected to the deflection plates 7, 7' or to the scanning circuit of a camera 1 for slot scanning, operating in a synchronous scanning mode, the ends of the secondary line section 10 being connected respectively by means of connection lines 14, 14' to one of the two deflection plates 7 or 7' of said camera 1 (FIGS. 1 and 2).

A practical embodiment of the invention, in the framework of a use as mentioned above, can be described with reference to FIGS. 1, 2 and 3 of the accompanying drawings.

As these figures show, the coupling and matching circuit comprises a fine adjustment of the capacitance of the plates 7, 7' for deviation or deflection (=4 pF) and an adjustment of the transformation between the output resistance R'S (=50 Ω) of amplifier 6 and the input resistance of the deflection circuit corresponding substantially to the losses R'S+R'P in the tube.

The circuit 8 is comprised essentially of two sections or portions of lines of the "microstrip" type in the air which are parallel along a length of about 3 cm and weakly coupled.

One (9) of said lines (the so-called "primary") is short-circuited, its other end being connected to the energizing generator (amplifier 6) of internal resistance or of outlet RS (=50 Ω).

The second line 10 (or secondary) is connected to the deflection assembly, particularly to the plates 7, 7', and its midpoint 16 is grounded so as to increase the rate of rejection of the common mode. This decoupling of the scanning circuit 2' relative to the other electrodes of the tube of the camera is interesting especially when one of them is pulsed.

Finally, it should be noted that the ground plane 11 forms an integral part of the external electromagnetic shielding 11' which avoids radiation losses (this shielding is shown only by broken lines in FIG. 2 so as not to complicate the drawing).

The characteristic impedance Z1 of the primary line section 9 is fairly small such that its equivalent inductance L1 will be negligible with respect to RS.

On the contrary, that of the secondary line section 10 of length 1 (≈4 cm), is higher (Z2≈100 Ω) and under these circumstances, this section or this secondary portion is practically equal to an adjustable inductance L2 given by the expression:

$$L2=Z2\times l/c\approx 15\text{ nH}$$

Acting on the screw 12 varies the distance between the ground plane 11 and the secondary line 10: as a result, there is a variation in the same direction of Z2 and, as a consequence, of L2.

Moreover, the screw 13' permits modifying the separation of the two portions 9' and 10' and hence the degree of coupling (weak) between the primary and the secondary: this effect could be described by a complete voltage step-down transformer, of an adjustable ratio k (~0.1).

The assembly of amplifier 6 and circuit 8 and the deflection circuit (plates 7, 7') is equivalent to the quadripole shown in FIG. 3.

In this diagram, the series resistances R'S and parallel resistances R'P characterize respectively ohmic and dielectric losses in the deflection circuit (plates 7, 7'). LG2 designates the overall inductance which integrates that of the connection lines 14, 14' and, if necessary, that of self-trimming capacitor 15; it is selected such that:

$$(LG2+L2)\omega=l/CG2\times\omega$$

From this can be deduced the conditions for matching $$k^2RS\cong R'S+l/R'P(CG2\times\Omega)^2$$

$$CG2\ (L2+LG2=k^2\times L1)=CG2\ (LG2+L2)=1$$

These two equations show that:

the scanning circuit agrees nicely by adjusting the variable inductance L2 (screw 12), the matching of the resistances is obtained by adjusting the coefficient k and, hence, the coupling between the primary and the secondary (screw 13').

The circuit 8 for coupling and matching therefore has bee provided by using techniques suitable to the circuits operating at high frequencies and at ultra-high frequencies, in particular, by using lines of the "microstrip" type or microribbon weakly coupled by electric field. This design guarantees a reduced size and negligible losses whilst minimizing radiation by external shielding 11'.

Moreover, the judicious selection of the geometric parameters of the secondary line 10 permits decreasing sufficiently the inductance L2 so that the image converter tube of the camera 2 can function at a frequency very near its resonance.

Moreover, this circuit, less cumbersome and less costly to produce, is provided with two simple and precise adjustments to control the agreement of the deflection circuit and the transformation ratio.

We claim:

1. A coupling and matching circuit for the transmission of high frequency and hyperfrequency signals, the circuit connecting a relatively low output impedance device with a relatively high input impedance device, the circuit comprising:

primary and secondary line sections (9, 10) having portions (9', 10') disposed in parallel and weakly coupled with each other;

a ground plane (11) disposed parallel to the secondary line section (10) and adapted to form a portion of a shielding envelope (11') surrounding the coupling and matching circuit;

means (12) for relative displacement of the secondary line section (10) with respect to the ground plane (11), the primary line section (9), forming a short circuit, being connected to the relatively low output impedance device and the secondary line section (10) being connected to the relatively high input impedance device and having a midpoint connected to said around plane.

2. The coupling and matching circuit according to claim 1, further comprising means (13, 13') for varying a displacement between the primary line section (9) and the secondary line section (10).

3. The coupling and matching circuit according to claim 1, wherein the primary line section (9) comprises a microribbon line in the air whose length and characteristic impedance (Z1) are sufficiently low that its equivalent inductance (L1) will be negligible relative to an output resistance (RS) of the device with low output impedance, and wherein the secondary line section (10) comprises a microribbon line in the air and has a characteristic impedance (Z2) sufficiently high that said secondary line section (10) can be assimilated to a pure inductance (L2) whose value is given by the expression:

$$L2=Z2\times l/c$$

wherein l is the length of the secondary line section (10) facing the ground (11), and c is the speed of the light.

4. The coupling and matching circuit according to claim 3, wherein for a given value of inductance (L2) of the secondary line section (10), a sum (LG2) of the values of inductances of the device with very high input impedance and of connection wires (14, 14') thereto and of a trimming self-inductance winding (15), when present, is fixed such that:

$$(L2+LG2)\omega=l/CG2\times\omega$$

in which CG 2 corresponds to the overall capacitance of the device with very high input impedance, of the connection wires (14, 14') and of the secondary line section (10) and ω corresponds to the angular frequency of the transmitted signals.

5. The coupling and matching circuit according to claim 1, wherein said means (12) for relative displacement of the secondary line section (10) relative to the ground plane (11) comprises means for deforming said ground plane (11) by flexure.

6. The coupling and matching circuit according to claim 1, wherein the device with a relatively high input impedance is a camera for slot scanning having deflection plates, and further comprising a scanning synchronization loop (2) connected to the deflection plates, ends of the secondary line section (10) being connected by means of connection lines (14, 14') to one of the deflection plates.

7. A coupling and matching circuit for the transmission of high frequency and hyperfrequency signals, the circuit connecting a relatively low output impedance device with a relatively high input impedance device, the circuit comprising:

primary and secondary line sections having portions disposed in parallel and weakly coupling with each other;

a ground plane disposed parallel to the secondary line section and adapted to form a portion of a shielding envelope surrounding the coupling and matching circuit;

means for varying the distance between the secondary line section and the ground plane;

means for varying a displacement between the primary line section and the secondary line section; and the primary line section, forming a short circuit, being connected to the relatively low output impedance device and the secondary line section being connected to the relatively high input impedance device.

8. The coupling and matching circuit according to claim 7, wherein the primary line section (9) is mounted on a support (13) adapted to be displaced or inclined in a direction perpendicular to longitudinal axes of the portions of the time sections (9' and 10') by said means for varying a displacement.

9. The coupling and matching circuit according to claim 8, wherein said means for varying a displacement comprises a screw of small pitch, disposed in a fixed insulating support.

10. A coupling and matching circuit for the transmission of high frequency and hyperfrequency signals, the circuit connecting a relatively low output impedance device with a relatively high input impedance device, the circuit comprising:

primary and secondary line sections having portions disposed in parallel and weakly coupled with each other, the primary line section comprising a micro ribbon line in the air whose length and characteristic impedance are sufficiently low that its equivalent inductance will be negligible relative to an output resistance of the device with low output impedance, and the secondary line section comprising a micro ribbon line in the air that has a characteristic impedance (Z2) sufficiently high that the secondary line section can be assimilated to a pure inductance (L2) whose value is given by the expression:

$$L2=Z2\times l/c$$

where l is the length of the secondary line section facing the ground plane, and c is the speed of the light, wherein for a given value of inductance of the secondary line section, a sum (LG2) of the values of the inductances of the device with relatively high input impedance and of connection wires thereto and of a trimming self-inductance winding, when present, is fixed such that:

$$(L2+LG2)\omega=l/CG2\times\omega$$

in which CG2 corresponds to the overall capacitance of the device with very high input impedance, of the connection wires (14, 14') and of the secondary line section (10) and ω corresponds to the angular frequency of the transmitted signals;

a ground plane disposed parallel to the secondary line section and adapted to form a portion of a shielding envelope surrounding the coupling and matching circuit;

means for relative displacement of the secondary line section with respect to the ground plane, the primary line section, forming a short circuit, being connected to the relatively low output impedance device and the secondary line section being connected to the relatively high input impedance device.

* * * * *